US005521887A

United States Patent [19]

Loomis

[11] Patent Number: 5,521,887

[45] Date of Patent: May 28, 1996

[54] TIME TRANSFER SYSTEM

[75] Inventor: Peter V. W. Loomis, Sunnyvale, Calif.

[73] Assignee: Trimble Navigation Limited, Sunnyvale, Calif.

[21] Appl. No.: 99,907

[22] Filed: Jul. 30, 1993

[51] Int. Cl.[6] ..... G04C 11/02

[52] U.S. Cl. ..... 368/47

[58] Field of Search ..... 368/46–55

[56] References Cited

U.S. PATENT DOCUMENTS 4,899,117 2/1990 Vig ..... 331/3

5,168,478 12/1992 Baker ..... 368/202

*Primary Examiner*—Bernard Roskoski

*Attorney, Agent, or Firm*—John Schipper

[57] ABSTRACT

Apparatus for providing accurate local time for one or more timed devices that depend on such time for operation. In one embodiment, a Satellite Positioning System (SATPS), such as GPS or GLONASS, provides the time signal information. In another embodiment, the time signal information is provided by telecommunication means, such as a telephone, cellular telephone or similar apparatus. The local time signal is distributed by a time signal distribution module to one or more timed devices by a wire or transmission line, by radio waves, or by direct contact with an input terminal of a timed device. The time signal distribution module may be a single station, a master station for a system of timed devices, or a portable module that can be moved from one timed device to the next.

1 Claim, 3 Drawing Sheets

TIME TRANSFER SYSTEM

FIELD OF THE INVENTION

This invention relates to provision of accurate time for devices that display or are controlled by time in a household or business.

BACKGROUND OF THE INVENTION

A "timed device", that is, a device that displays the present time or is controlled by time in its operation, is often found to display or to rely upon an incorrect time and must therefore be reset. Timed devices in which this situation occurs include clocks that control cooking intervals in the kitchen, clocks used for automatic or manually controlled VCR recording of a video program, clocks for lawn sprinkler systems, home and office burglar system alarms, and vault door locking/unlocking systems. A time, accurate when given to a timed device, may later become inaccurate because of loss or marked diminution of electrical power supplied to the device, because the time interval for operation must be changed, because the timed device has passed into another time zone, or for many other reasons. Many workers have provided sources for timing control and similar activities in a commercial context.

One approach is disclosed in U.S. Pat. No. 3,520,128, issued to Novikov et al for an automatic time distribution system. An independent primary clock is connected to, and provides exact time signals for, a plurality of secondary clocks by radio waves. Each secondary clock receives a sequence of uncorrected "exact" time signals and a sequence of timing marks to correct this uncorrected time. The time signals for each secondary clock are apparently corrected separately.

Cater, in U.S. Pat. No. 3,811,265, discloses transmission of coded, time-indicating signals from a master clock at a central station to one or more slave clocks, using a two-wire line and binary-valued pulses with different time durations. A time synchronizing pulse is periodically inserted (e.g., once per second) on the line to correct for drift or other errors. If the two-wire line is a standard 60-cycle power line or a television cable, the binary-valued pulses use one or more frequencies that lie outside the frequency range normally used on that line, to avoid signal interference with the standard signals transmitted over that line.

A clock that can be synchronized by "wireless" signals is disclosed by Gerum et al in U.S. Pat. No. 3,881,310. The clock contains an electromagnetically operated mechanical oscillator whose frequency 2f0 is twice the rated frequency of an alternating current network connected to the clock. A time synchronization module transmits a signal of frequency f1>>f0 that is modulated by the network at 2f0 and received and demodulated by the clock. Normally, the pulses received from the network drive the clock and the oscillator is in a standby mode. The clock oscillator is enabled, and the network is disconnected, when and only when the network frequency differs by at least a predetermined amount from the frequency 2f0 of the oscillator. The oscillator in standby mode receives resonance energy of frequency≈2f0 from the network for maintaining the oscillations.

A TACAN air navigation system is disclosed in U.S. Pat. No. 3,969,616, issued to Mimken. Range of an aircraft from an interrogation signal-transmitting beacon is determined by the lapse in time between transmission of the interrogation signal and receipt of a reply pulse signal from the aircraft (called a "dwell" period in TACAN parlance). A circuit at the beacon generates and uses a filler pulse during any dwell period in which a reply pulse is not received from a target aircraft, in order to maintain an rough and unspecified synchronization at the beacon for the target aircraft when reply pulses are not received. An aircraft velocity detector may be included, with velocity being determined by averaging over several successive dwell periods to reduce the associated velocity error.

Cateora et al, in U.S. Pat. No. 4,014,166, disclose a satellite-controlled digital clock system for maintaining time synchronization. A coded message containing the present time and satellite position is transmitted from a ground station to an orbiting satellite and is relayed to a group of ground-based receivers. A local oscillator aboard the satellite is phase-locked to a precise frequency to provide the system with accurate time-of-year information by a count of the accumulated pulses produced by the oscillator. This count is compared with a time count determined from the coded message received by the satellite. After a selected number of errors are observed through such comparisons, the on-board clock is reset to the time indicated by the coded messages received. If transmission of the coded messages is interrupted, the on-board oscillator continues to provide time information that is transmitted to the ground-based receivers.

U.S. Pat. No. 4,204,398, issued to Lemelson, discloses method and apparatus for automatically resetting a timepiece according to the local time zone. Apparatus, which is attached to and controls the time rate and displayed time of the timepiece, receives electrical signals comparing the local time with the time shown by the timepiece. If these two times do not agree, the rate of change of the timepiece is increased markedly until the two times (modulo 12 hours or 24 hours, depending upon the timepiece) agree. The timepiece rate of change is then returned to its normal value until another discrepancy in time is sensed. Resetting of the timepiece is activated only after a time comparison occurs. This invention relies upon provision of the local time zone standard from a source that may not be available globally.

Electronic timepiece rate and time adjustment apparatus is disclosed in U.S. Pat. No. 4,209,975, issued to Moritani et al. The apparatus uses frequency division of a crystal oscillator output signal to provide a sequence of time-counting pulses to change the displayed time on an electronic timepiece such as a digital clock. The pulse rate can be changed when the time approaches the desired set time so that the resetting procedure does not "overrun" the desired set time. The desired resetting time is determined mentally, not automatically, and the time resetting procedure is largely manual.

An antenna space diversity system for TDMA communication with a satellite is disclosed by U.S. Pat. No. 4,218,654, issued to Ogawa et al. Differences of temporal lengths of paths from the satellite through each antenna to a ground-based signal processor station are determined by measurement of times required for receipt of pre-transmission bursts sent in the respective allocated time slots through two different antennas, in a round trip from base station to satellite to base station. Variable time delays are then inserted in the base station signal processing circuits to compensate for the temporal length differences for the different signal paths. These time delays are changed as the satellite position changes relative to each of the antennas.

U.S. Pat. No. 4,287,597, issued to Paynter et al, discloses receipt of coded time and date signal from two geosynchronous satellites, which signals are then converted into local date and time and displayed. The frequency spectrum is scanned by an antenna to identify and receive the satellite signals. Temporal length differences for signal paths from each satellite through a receiving antenna to a signal processing base station are determined, to provide compensation at the base station for these differences. Time information is provided by a satellite every 0.5 seconds, and this information is corrected every 30 seconds. Signals from either or both satellites are used to provide the time and date information, in normal local time and/or daylight savings local time.

Jueneman discloses an open loop TDMA communications system for spacecraft in U.S. Pat. No. 4,292,683. A spacecraft, such as a satellite, in quasi-geosynchronous orbit carries a transponder that relays a coded signal from a ground-based signal-transmitting station to a plurality of spaced apart, ground-based receivers. This coded signal includes a time index and an index indicating the spacecraft's present position. The time index is adjusted by each receiver to compensate for the changing position of the spacecraft through which the coded signal is relayed. The system is open loop and requires no feedback from the receivers to the base station.

Nard et al, in U.S. Pat. No. 4,334,314, disclose a system for radio wave transmission of time-referenced signals between two ground-based stations, with compensation for multi-path transmission timing errors. Station no. 1 has a single antenna. Station no. 2 has two antennas, spaced apart by a selected distance, to allow measurement of and compensation for multi-path transmission path length differences. A signal processor located at the receiver antenna combines a plurality of timing marks, received from the transmitting antenna along multiple paths, into a single timing mark that compensates for the multiple path length differences. This arrangement allegedly allows station-to-station transmission over distances as large as ten times the transhorizon or direct sighting distance (which is approximately proportional to the square root of the product of antenna height and Earth's radius).

Method and apparatus for determining the elapsed time between an initiating event and some other event are disclosed by U.S. Pat. No. 4,449,830, issued to Bulgier. A first timer and a second time mark the times of occurrence, respectively, of an initiating event and a subsequent event that depends upon occurrence of the initiating event. The two timers are initially connected and synchronized, then disconnected before the initiating event occurs. The timers are then reconnected after both events have occurred, to allow determination of the elapsed time between occurrence of the two events.

In U.S. Pat. No. 4,482,255, Gygax et al disclose a timepiece for displaying both the present time and the present orientation of the time piece relative to the local Earth's magnetic field. The timepiece displays time, date, and the direction and angle through which the timepiece must be rotated in a tangent plane to align a fixed axis on the timepiece with the local field. The local magnetic field direction can be determined by two (static) Hall effect sensors placed at right angles to each other.

Distance ranging and time synchronization between a pair of satellites is disclosed by Schwartz in U.S. Pat. No. 4,494,211. Each satellite transmits a timing signal and receives a timing signal from the other satellite. The difference in time, including compensation for signal processing delay on a satellite, between transmission and receipt of the signals is transmitted by each satellite to the other satellite and is used to establish time synchronization and to determine the distance between the two satellites. This exchange of signals would be repeated at selected time intervals to maintain synchronization, where the satellites are moving relative to each other. No communications link to a third entity is required, and only one of the satellite clocks need be adjusted to establish and maintain time synchronization. Possible use of this approach for two or more satellites in the NAVSTAR global positioning system is mentioned.

Plangger et al, in U.S. Pat. No. 4,582,434, disclose transmission and receipt of a continuously corrected sequence of timing signals. A microprocessor at the receiver periodically compares these timing signals with on-board timing signals generated by a local clock. A varactor diode in a crystal oscillator circuit is adjusted to adjust the microprocessor's operating frequency to minimize any error between the two timing signal sequences. Timing signal processing delay time is compensated for in a receiver circuit. The frequency for microprocessor operation is thus continuously corrected. If the transmitted timing signals are too weak, or do not arrive, the on-board timing signals are used to control the microprocessor until the transmitted timing signals are received in sufficient strength again.

A portable timekeeping device that provides reminders (alarms) for taking certain actions at naturally occurring times is disclosed in U.S. Pat. No. 4,512,667, issued to Doulton et al. Means are provided for entering information on the present geographical location, and the device computes the appropriate times for taking the actions based upon the location and local time of day and year. The intended application here is for an alarm indicating the appropriate times after sunrise and before sunset for Moslem prayers. The present geographical location is entered and used together with the present time and present time of year (computed using a timekeeping device plus information stored in a ROM) to determine the appropriate times of day. A visually or audibly perceptible alarm is provided at each appropriate time of the day.

Noguchi discloses a remote time calibration system using a satellite in U.S. Pat. No. 4,607,257. A base station provides a reference system of absolute timing signals and transmits these to a satellite that orbits the Earth. The satellite then calibrates and periodically adjusts its internally generated time and transmits observed data plus the corresponding adjusted satellite time to one or more data receiving stations on the Earth that are distinct from the base station. Time calibration optionally compensates for signal propagation time delay from base station to satellite and allows continuous transmission of data from satellite to the data receiving station(s). Several time difference indicia are computed here.

Several patents disclose data communications protocol for an electronic network having a plurality of interacting, intelligent cells that receive and act upon information continuously provided by the network: U.S. Pat. Nos. 5,018,138, issued to Twitty et al; 5,034,882, issued to Eisenhard et al; 5,113,498, issued to Evan et al; 4,148,144, issued to Sutterlin et al; and 5,189,683, issued to Cowart. These patents may use control signals to coordinate the commands sent across a network but make no special provision for setting, resetting or synchronizing the time for all relevant timed devices.

Some of the references discussed above assume that a source of time is locally available. Other references provide time signals from a remote source but do not take account of the time delay caused by propagation of such time signal from the time source to the timed device, or of the possibility that the time source or the timed device may move relative to each other from time to time. What is needed is a system that: (1) provides accurate time, or a continuous sequence of accurate timing signals, for a timed device or plurality of timed devices, anywhere in the world; (2) automatically compensates for the propagation delay of a time signal, even if the timed device and/or the time signal source move from time to time; (3) is portable and can be easily reset for any time zone in which the timed device is located; and (4) can be used discretionarily, if desired, to provide time signals for some but not all timed devices in an environment.

SUMMARY OF THE INVENTION

These needs are met by the invention, which provides local time determined by a Satellite Positioning System (SATPS) or another localized time signal source for one or a plurality of timed devices through an intermediary timing transfer device that is either portable or is attached to a network linking all timed devices in a system. The SATPS-based system includes an SATPS antenna to receive SATPS signals from one or more SATPS satellites and an SATPS receiver/processor that receives these SATPS signals from the antenna and determines the location of the antenna and accurate local time based upon this location.

Another accurate time signal source is distance-compensated time signals provided over a telephone line, cellular phone or telephone network, using either wires or a wireless connection. The present location of the time signal source is known, and the present location of the telephone is either known or determined. Time delay, due to a finite signal propagation velocity from time signal source to the telephone, is determined, and the time signal received from the time signal source is adjusted based upon this signal propagation time delay to provide a local time signal that has an associated inaccuracy of no more than one millisecond(m-sec).

An SATPS antenna and receiver/processor will download, directly or indirectly, SATPS signals that provide local time into all designated electronic timed devices, such as: clocks; clock radios; car clocks; battery-operated timepieces, such as wrist watches; VCRs; stereo systems; microwave units and other kitchen appliances; home security systems; and lighting, heating, cooling, watering and pumping/filtering systems for the home. A telephone-based system will operate in a similar manner, after compensation for signal propagation time delay from the time signal source to an intermediary timing transfer device.

Three approaches are available for such downloading in an SATPS-based or telephone-based system. (1) Direct download from a portable or fixed-location timing transfer device, through a wired or wireless connection. The target timed device would contain a socket or wireless input terminal, such as an infrared signal receiver. (2) Indirect download of the time signal(s) to an intermediate, portable timing transfer device that can be carried to each target timed device. Time signal transfers may implemented by a controller using infrared or other electromagnetic, possibly similar to a video controller but having one control button for time upload from the time signal source and a second control button for time download. (3) Coordinated download to many target timed devices in a single operation by a master clock that receives timing signals from the time source, such as one or more SATPS satellites. A dedicated time signal receiver, such as an SATPS antenna and receiver/processor or telephone line, may be used for this purpose. Optionally, a visual display for the local time and/or date may be provided as part of the system that receives the downloaded time signal and/or date signal.

DETAILED DESCRIPTION OF THE INVENTION

Figure 1:
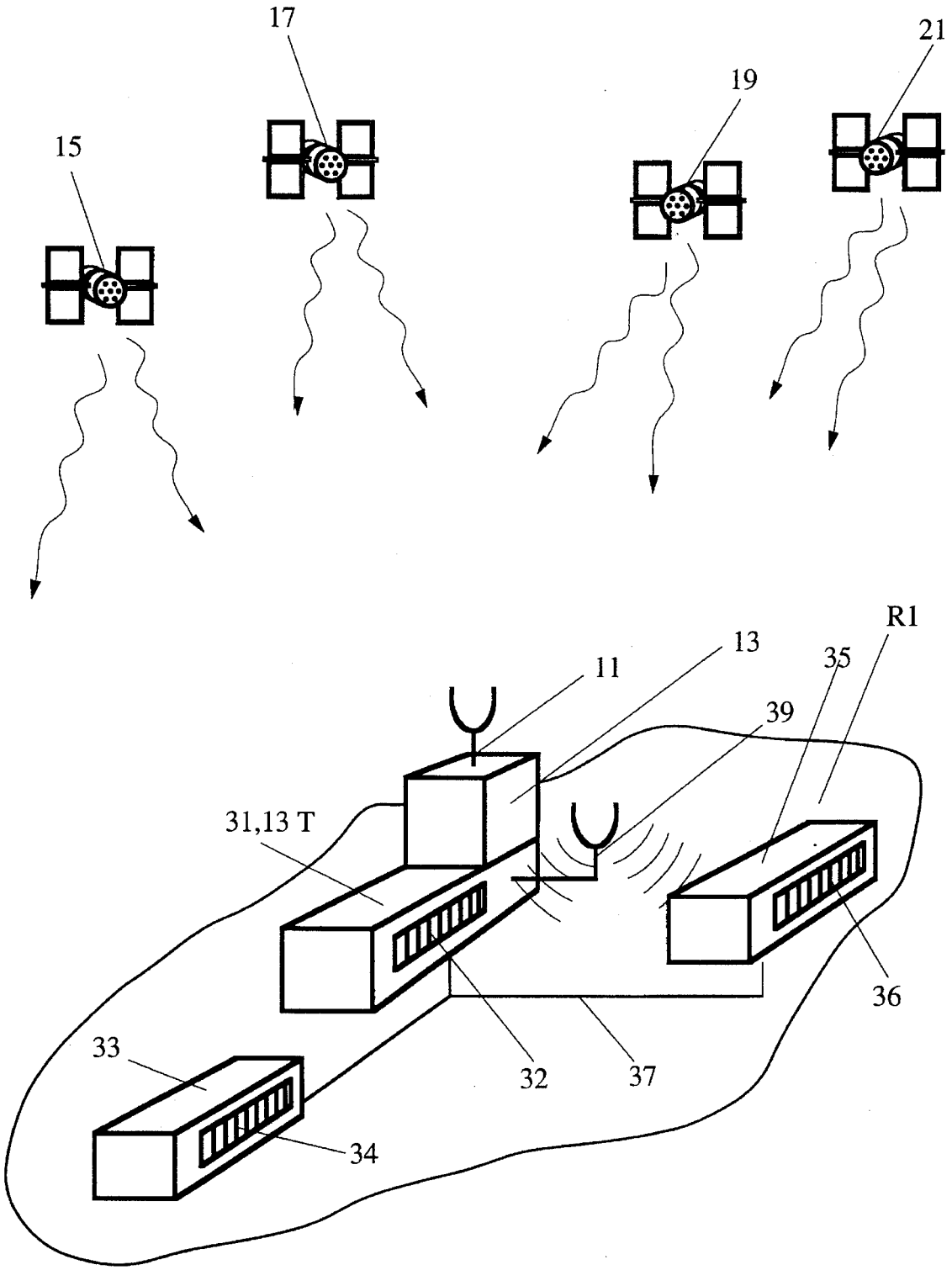
FIG. 1 is a schematic view of an SATPS-based system for providing local time signals according to a first embodiment of the invention.

FIG. 1 illustrates an SATPS-based embodiment of the invention in which an SATPS antenna 11 and associated SATPS receiver/processor 13 receive SATPS signals from one or more SATPS satellites 15, 17, 19 and 21. The receiver/processor 13 receives the SATPS signals from the antenna 11 and determines the local time based upon these signals, using approaches that are well known to workers in the satellite positioning art. Optionally, the antenna 11 and receiver/processor 13 can receive SATPS signals from three or more SATPS satellites and can also determine the location of the antenna 11, according to well known principles in the satellite positioning art.

An SATPS antenna receives SATPS signals from one or a plurality of SATPS satellites and passes these signals to an SATPS signal receiver/processor, which (1) identifies the SATPS satellite source for each SATPS signal, (2) determines the time at which each identified SATPS signal arrives at the antenna, and (3) determines the present location of the SATPS antenna from this information and from information on the ephemerides for each identified SATPS satellite. The SATPS signal antenna and signal receiver/processor are part of the user segment of a particular SATPS, the Global Positioning System, as discussed by Tom Logsdon in *The NAVSTAR Global Positioning System,* Van Nostrand Reinhold, 1992, pp. 33–90, incorporated by reference herein.

In a first mode of the first embodiment, a timed device 31 is located adjacent to the SATPS receiver/processor 13 and receives signals representing the local time directly from the receiver/processor. This mode requires that each timed device be located adjacent to, and be electrically connected to, an SATPS receiver/processor. Often, this will require provision of several SATPS receiver/processors. If timing signals with an inaccuracy of no more than, say, one microsecond (μsec) are required for a particular timing device, the adjacent SATPS antenna 11 can be immobilized and its three-dimensional location can be fixed with high accuracy. With the location of the antenna 11 accurately known, SATPS signals received from several SATPS satellites can be used to provide local time signals with the required accuracy.

As used herein, the phrase "time signal" includes but is not necessarily limited to: (1) a digital signal or message that can be decoded into a local time and/or date; (2) a digital signal or message that can be decoded into a local time and/or date, having an associated timing mark that may occur before or after the digital signal is received; or (3) a digital or analog signal or message that is used to align the time of a device that receives this signal.

In a second mode of the embodiment, the SATPS receiver/processor 13 includes or is connected to a time signal transmitter 13T. Timed devices 33 and 35 are spaced apart from the transmitter 13T, and each timed device has an input terminal or port (which may include a signal-receiving antenna) that receives local time signals from the SATPS receiver/processor 13 and transmitter 13T. The local time signals can be received on a time signal wire or transmission line 37 connecting the timed devices 33 and 35 to the transmitter 13T. Alternatively, a time signal antenna and/or transmitter 39 can be used to transmit the local time signals by radio waves to the timed devices 33 and 35. The SATPS antenna 11, SATPS receiver/processor 13, transmitter 13T, timed device 31 or timed devices 33 and 35, time signal transmission line 37 and time signal antenna 39 are located adjacent to each other in a region R1. Optionally, the timed device 31, 33 or 35 may have a visual display 32, 34 or 36, respectively, to display the local time and/or date.

Figure 2:
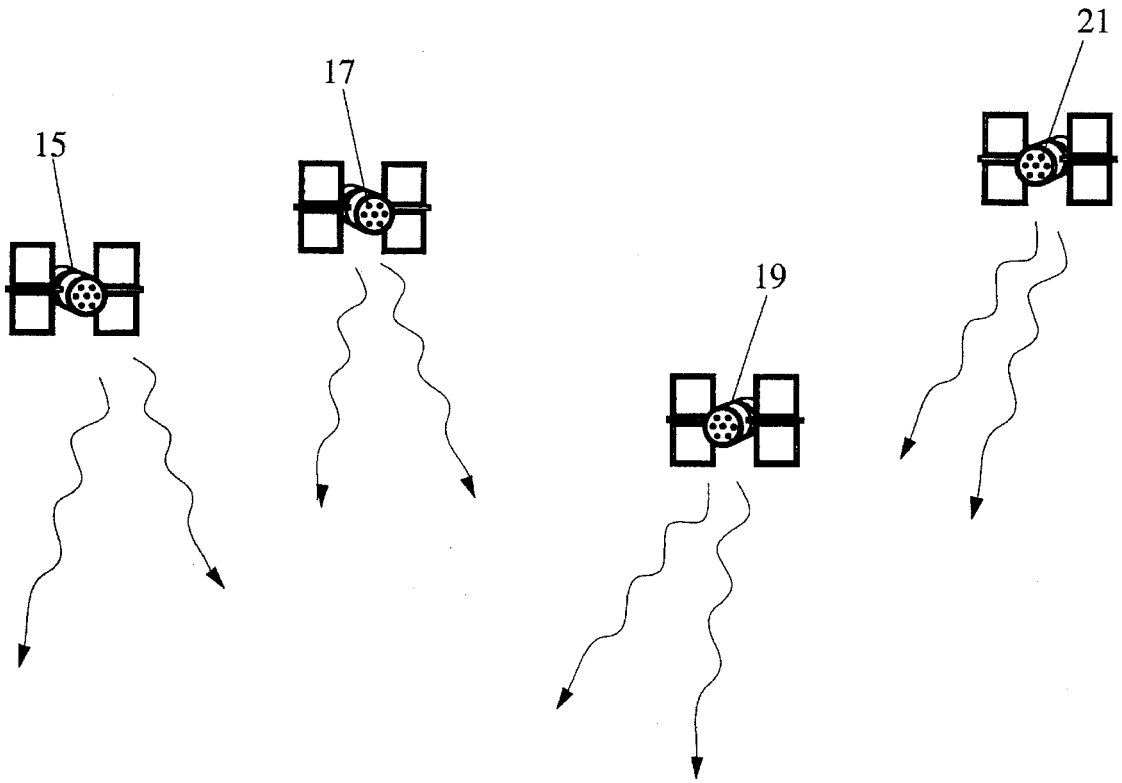
FIG. 2 is a schematic view of an telephone-based system for providing local time signals according to another mode of the first embodiment of the invention, using a portable intermediate source for the local time.
Figure 2:
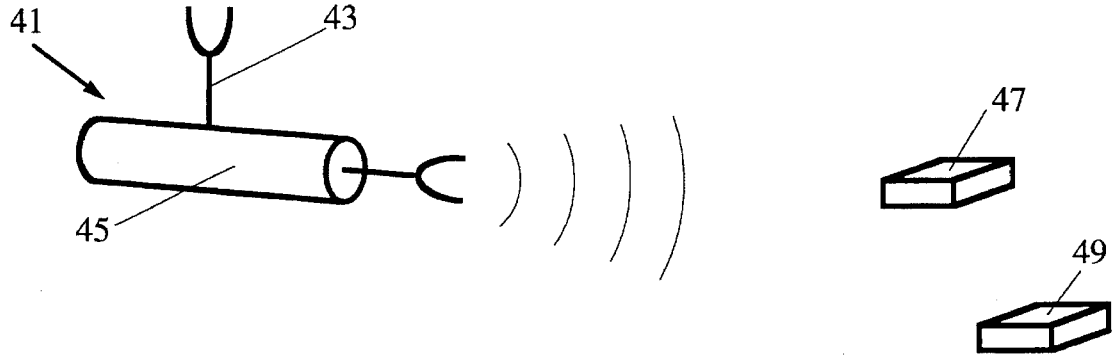

In a third mode of the first embodiment, illustrated in FIG. 2, SATPS signals are received at a portable, preferably hand held, SATPS unit 41, including an SATPS antenna 43 and SATPS receiver/processor 45 that determines the local time from these SATPS signals. The SATPS unit 41 then transmits local time signals by radiowave or by electrical signals to an input terminal of each timed device 47 and 49, for setting or resetting the local time for that device. The SATPS unit 41 can transmit the local time signals to a timed device from a distance, or the SATPS unit 41 can be pressed against the input terminal of a timed device to transfer the time signal directly.

Figure 3:
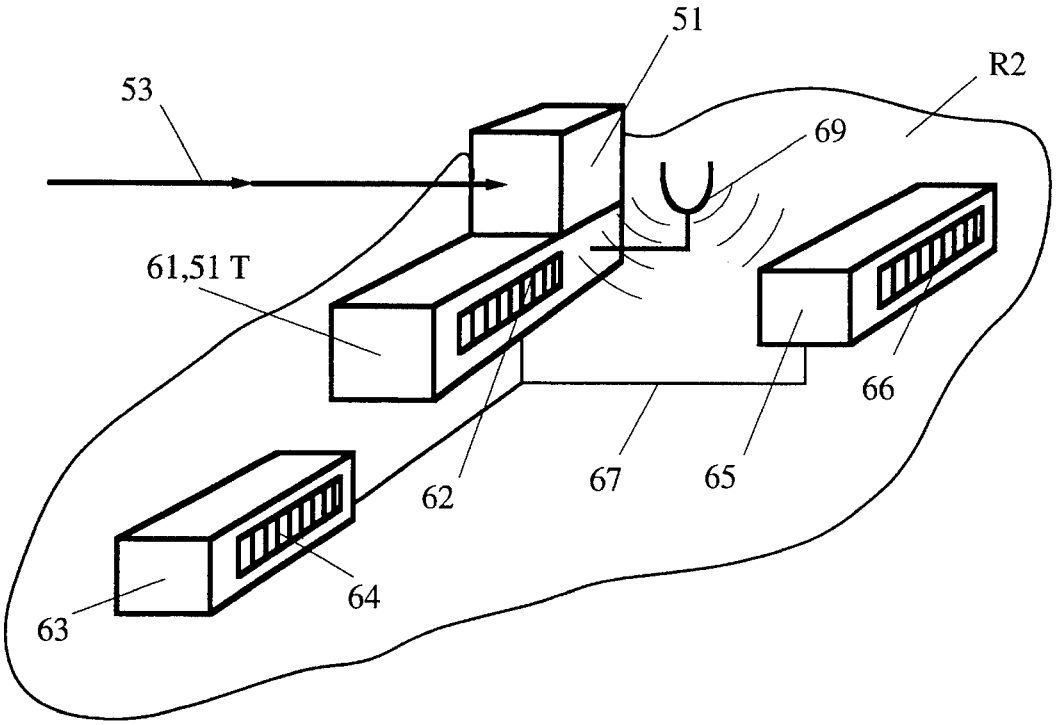
FIG. 3 is a schematic view of an SATPS-based system for providing local time signals according to a second embodiment of the invention.

FIG. 3 illustrates a second embodiment of the invention, wherein a time signal distribution module 51 receives a sequence of signals representing local time on a time source wire or transmission line 53, for distribution to one or more adjacent timed devices.

In a first mode of the second embodiment, a timed device 61 is located adjacent to the distribution module 51 and receives signals representing the local time directly from the distribution module. This mode requires that each timed device be located adjacent to, and be electrically connected to, a distribution module. This will often require provision of several time signal distribution modules. Once again, if the location of the time signal distribution module 51 is known with sufficiently high accuracy and is immobilized, signal propagation time delay on the line 53 can be compensated for, and inaccuracy of the local time signal received by a timed device 63 can be reduced to one or a few microseconds or less.

In a second mode of the second embodiment, the time signal distribution module 51 includes or is connected to a time signal transmitter 51T. Timed devices 63 and 65 are spaced apart from the transmitter 51T, and each timed device has an input terminal or port (which may include a signal-receiving antenna) that receives local time signals from the module 51 and transmitter 51T. The local time signals can be received on a time signal wire or transmission line 67 connecting the timed devices 63 and 65 to the transmitter 51T. Alternatively, a time signal antenna and/or transmitter 69 can be used to transmit the local time signals by radio waves or electrical signals to the timed devices 63 and 65. The time signal distribution module 51, transmitter 51T, timed device 61 or timed devices 63 and 65, time signal transmission line 67 and time signal antenna/transmitter 69 are located adjacent to each other in a region R2. Alternatively, the timed device 61, 63 or 65 in FIG. 3 may have a visual display 62, 64 or 66, respectively, for the local time and/or date.

Figure 4:
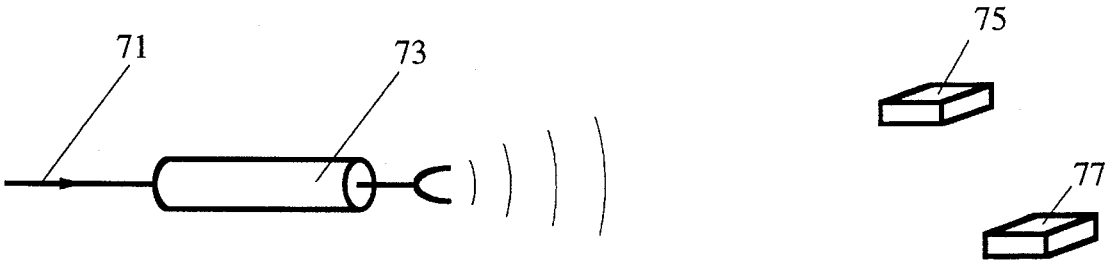
FIG. 4 is a schematic view of an telephone-based system for providing local time signals according to another mode of the second embodiment of the invention, using a portable intermediate source for the local time.

In a third mode of the second embodiment, illustrated in FIG. 4, signals representing local time are received from a time signal source wire or transmission line 71 at a portable, preferably hand held, time distribution module 73 that determines the local time from these input signals. The time distribution module 73 then transmits local time signals by radiowave to an input terminal of each timed device 75 and 77, for setting or resetting the local time for that device. The time distribution module 73 can transmit the local time signals to a timed device from a distance, or the module 73 can be pressed against the input terminal of a timed device to transfer the time signal directly.

Alternatively, the local time signal may be received by a cellular telephone, and the transmission line 53 (FIG. 3) or 71 (FIG. 4) may be the air, acting as a transmission medium. Here, no wire is required for the transmission line and the time signal distribution module 61 or 73 in FIG. 3 or FIG. 4, respectively, need not be stationary. This allows additional 15 freedom of movement for the time distribution module.

A Satellite Positioning System (SATPS) is a system of satellite signal transmitters, with receivers located on the Earth's surface or adjacent to the Earth's surface, that transmits information from which an observer's present location and/or the time of observation can be determined. Two operational systems, each of which qualifies as an SATPS, are the Global Positioning System and the Global Orbiting Navigational System.

The Global Positioning System (GPS) is part of a satellite-based navigation system developed by the United States Defense Department under its NAVSTAR satellite program. A fully operational GPS includes up to 24 satellites approximately uniformly dispersed around six circular orbits with four satellites each, the orbits being inclined at an angle of 55° relative to the equator and being separated from each other by multiples of 60° longitude. The orbits have radii of 26,560 kilometers and are approximately circular. The orbits are non-geosynchronous, with 0.5 sidereal day (11.967 hours) orbital time intervals, so that the satellites move with time relative to the Earth below. Theoretically, three or more GPS satellites will be visible from most points on the Earth's surface, and visual access to two or more such satellites can be used to determine an observer's position anywhere on the Earth's surface, 24 hours per day. Each satellite carries a cesium or rubidium atomic clock to provide timing information for the signals transmitted by the satellites. Internal clock correction is provided for each satellite clock.

Each GPS satellite transmits two spread spectrum, L-band carrier signals: an L1 signal having a frequency f1=1575.42 MHz and an L2 signal having a frequency f2=1227.6 MHz. These two frequencies are integral multiples f1=1540 f0 and f2=1200 f0 of a base frequency f0=1.023 MHz. The L1 signal from each satellite is binary phase shift key (BPSK) modulated by two pseudo-random noise (PRN) codes in phase quadrature, designated as the P-code and P-code. The L2 signal from each satellite is BPSK modulated by only the C/A-code. The nature of these PRN codes is described below.

One motivation for use of two carrier signals L1 and L2 is to allow partial compensation for propagation delay of such a signal through the ionosphere, which delay varies approximately as the inverse square of signal frequency f (delay$\propto f^{-2}$). This phenomenon is discussed by MacDoran in U.S. Pat. No. 4,463,357, which discussion is incorporated by reference herein. When transit time delay through the ionosphere is determined, a phase delay associated with a given carrier signal can be determined.

Use of the PRN codes allows use of a plurality of GPS satellite signals for determining an observer's position and for providing navigation information. A signal transmitted by a particular GPS signal is selected by generating and matching, or correlating, the PRN code for that particular satellite. All PRN codes are known and are generated or stored in GPS satellite signal receivers carried by ground observers. A first PRN code for each GPS satellite, sometimes referred to as a precision code or P-code, is a relatively long, fine-grained code having an associated clock or chip rate of 10 f0=10.23 MHz. A second PRN code for each GPS satellite, sometimes referred to as a clear/acquisition code or C/A-code, is intended to facilitate rapid satellite signal acquisition and hand-over to the P-code and is a relatively short, coarser-grained code having a clock or chip rate of f0=1.023 MHz. The C/A-code for any GPS satellite has a length of 1023 chips or time increments before this code repeats. The full P-code has a length of 259 days, with each satellite transmitting a unique portion of the full P-code. The portion of P-code used for a given GPS satellite has a length of precisely one week (7.000 days) before this code portion repeats. Accepted methods for generating the C/A-code and P-code are set forth in the document GPS Interface Control Document ICD-GPS-200, published by Rockwell International Corporation, Satellite Systems Division, Revision A, 26 Sep. 1984, which is incorporated by reference herein.

The GPS satellite bit stream includes navigational information on the ephemeris of the transmitting GPS satellite and an almanac for all GPS satellites, with parameters providing corrections for ionospheric signal propagation delays suitable for single frequency receivers and for an offset time between satellite clock time and true GPS time. The navigational information is transmitted at a rate of 50 Baud. A useful discussion of the GPS and techniques for obtaining position information from the satellite signals is found in Tom Logsdon, *The NAVSTAR Global Positioning System,* op cit, incorporated by reference herein.

A second configuration for global positioning is the Global Orbiting Navigation Satellite System (GLONASS), placed in orbit by the former Soviet Union and now maintained by the Russian Republic. GLONASS also uses 24 satellites, distributed approximately uniformly in three orbital planes of eight satellites each. Each orbital plane has a nominal inclination of 64.8° relative to the equator, and the three orbital planes are separated from each other by multiples of 120° longitude. The GLONASS circular orbits have smaller radii, about 25,510 kilometers, and a satellite period of revolution of 8/17 of a sidereal day (11.26 hours). A GLONASS satellite and a GPS satellite will thus complete 17 and 16 revolutions, respectively, around the Earth every 8 days. The GLONASS system uses two carrier signals L1 and L2 with frequencies of f1=(1.602+9k/16) GHz and f2=(1.246+7k/16) GHz, where k (=0, 1, 2, . . . , 23) is the channel or satellite number. These frequencies lie in two bands at 1.597–1.617 GHz (L1) and 1,240–1,260 GHz (L2). The L1 code is modulated by a C/A-code (chip rate=0.511 MHz) and by a P-code (chip rate=5.11 MHz). The L2 code is presently modulated only by the P-code. The GLONASS satellites also transmit navigational data at at rate of 50 Baud. Because the channel frequencies are distinguishable from each other, the P-code is the same, and the C/A-code is the same, for each satellite. The methods for receiving and analyzing the GLONASS signals are similar to the methods used for the GPS signals.

Reference to a Satellite Positioning System or SATPS herein refers to a Global Positioning System, to a Global Orbiting Navigation System, and to any other compatible satellite-based system that provides information by which an observer's position and the time of observation can be determined, all of which meet the requirements of the present invention.

A Satellite Positioning System (SATPS), such as the Global Positioning System (GPS) or the Global Orbiting Navigation Satellite System (GLONASS), uses transmission of coded radio signals, with the structure described above, from a plurality of Earth-orbiting satellites. A single passive receiver of such signals is capable of determining receiver absolute position in an Earth-centered, Earth-fixed coordinate reference system utilized by the SATPS.

I claim:

1. Apparatus for providing accurate local time for one or more timed devices, the apparatus comprising:

an SATPS antenna positioned to receive SATPS signals from one or more SATPS satellites;

an SATPS receiver/processor, connected to the SATPS antenna, to receive the SATPS signals and to compute an SATPS-determined local time based upon the location of the SATPS antenna; and portable timing signal transfer means, separate from and communicating with the receiver/processor, for receiving a sequence of at least two SATPS-determined local times as radio wave signals from the receiver/processor and for communicating a signal representing local time to at least one timed device that has a timed device input terminal, the timing signal transfer means having an output terminal that, when the output terminal is placed adjacent to and no more than about 300 meters from the timed device input terminal, communicates the SATPS-determined local time to the timed device.

* * * * *